United States Patent [19]

Simon

[11] Patent Number: 4,566,517

[45] Date of Patent: Jan. 28, 1986

[54] WINDOW SHADE ROLLER WITH MANUAL SEVERING MEANS

[75] Inventor: Terry L. Simon, Goshen, Ind.

[73] Assignee: The Breneman Company, Norcross, Ga.

[21] Appl. No.: 479,838

[22] Filed: Mar. 28, 1983

[51] Int. Cl.[4] ..... E06B 9/20

[52] U.S. Cl. ..... 160/263; 428/36

[58] Field of Search ..... 160/263, 250, 323 R, 160/236, DIG. 7; 428/36, 43, 906; 156/187, 176, 178; 206/605, 616

[56] References Cited

U.S. PATENT DOCUMENTS

| | | | |
|---|---|---|---|
| 1,316,591 | 9/1919 | Perry | 428/36 |
| 1,936,417 | 11/1933 | Ware | 206/616 |
| 2,173,791 | 9/1939 | Sarran | 160/238 |
| 2,464,436 | 3/1949 | Coy | 206/616 X |
| 3,870,086 | 3/1975 | Stark | 160/238 |
| 4,139,043 | 2/1979 | Donofrio | 160/263 |
| 4,157,108 | 6/1979 | Donofrio | 160/263 |
| 4,394,206 | 7/1983 | Clausen et al. | 206/616 |
| 4,438,799 | 3/1984 | Comeau | 160/263 |

FOREIGN PATENT DOCUMENTS

| | | | |
|---|---|---|---|
| 1458918 | 12/1976 | United Kingdom | 428/43 |

*Primary Examiner*—Ramon S. Britts
*Assistant Examiner*—Cherney S. Lieberman
*Attorney, Agent, or Firm*—Price, Heneveld, Huizenga & Cooper

[57] ABSTRACT

A tubular structure particularly but not exclusively useful as a window shade support roller comprises a convolutely-wound tube structure having a number of closely-wound wraps or layers of paper stock, preferably Stress Kraft paper coated with adhesive over all or most of its surface and wound into close layer-upon-layer surface adhesion, approximately six such layers providing high beam strength with low wall section or thickness. In addition, the tubular structure has readily-removable segmental lengths provided by use of "tear strips", i.e., tear strings, tear tapes, etc., which are placed upon the paper prior to winding thereof so as to be wound into spiral form during the convolute winding of the layers of paper, whereby pulling of such a tear strip around and around the tube progressively severs the tube at that point.

11 Claims, 10 Drawing Figures

WINDOW SHADE ROLLER WITH MANUAL SEVERING MEANS

BACKGROUND OF THE INVENTION

This invention relates to window shades, and in particular to the support rollers on which the shade material is wound. More particularly, the invention relates to window shade support rollers for the type of window shade which has come to be known as "manually sizable" or "handstrippable", and which includes a shade panel having a number of parallel, mutually spaced, scored (i.e., slit partially through), or other such "lines of weakness" along one or both lateral edges, by which the shade may be narrowed to a desired width by the consumer through exercise of merely manual efforts, i.e., in effect stripping off a particular amount of the shade fabric from one or both marginal edges along a selected scored line, or other "line of weakness", so as to end up with the particular width required for a particular window. Typically, the "lines of weakness" on the shade panel are formed by scoring or longitudinal slitting through a portion of the thickness of the shade panel material, thus establishing a straight and regular edge along which the material may subsequently be stripped, i.e., torn, the resulting edge after tearing having a very regular and smooth appearance appearing comparable to that of the original factory-cut edge.

In manually sizable window shades of the aforementioned type, the pre-scored shade panels must be mounted upon a support roller which in some way is adapted to being manually shortenable, so that the resulting narrowed shade panel is complemented by a correspondingly narrowed support roller, which corresponds in length to the width of the shade panel after the excess width has been removed. Various different types of shade rollers have heretofore been proposed for use with the pre-scored window shade material, which itself has been known for quite some time. Typically, all such rollers proposed heretofore have been the same as or very similar to the various window shade rollers previously in actual use, particularly those which have been used in conjunction with window shades that have been re-sized (narrowed) in more traditional ways at the point of purchase, e.g., by shade-cutting machines of the type which have long been known and used by window shade retailers.

For example, one such previously proposed manually sizable window shade construction (illustrated in the U.S. Patent to Ferguson, U.S. Pat. No. 4,006,770) utilizes the same basic telescoping metal tubular shade roller long used heretofore by other window shade companies, but proposes a two-step shade attachment procedure by which that portion of the window shade which is not pre-scored and not subject to subsequent hand-stripping is permanently attached to the main part of the telescoping support roller, whereas the scored portion of the shade is left unattached until the purchaser has narrowed the shade panel the requisite amount, by stripping off sufficient material, and has telescoped the support rod into itself sufficiently to make the overall length of the roller correspond to the width of the shortened shade panel, whereupon attachment of the shade panel to the roller is completed by adhering the previously unattached portion of the shade to the corresponding part of the telescoping roller.

In an earlier form of window shade product in which the scored shade material was initially suggested for use in the manually sizable manner generally alluded to above, the pre-scored shade material was merely used with a wood support roller which the consumer could foreshorten at home by use of a handsaw or the like, the manual stripping of the shade panel itself being the same as that described above.

Other forms of support roller proposed for use with the manually strippable, pre-scored window shade material have included tubular roller members of wound (e.g., convolute-wound) paper stock or the like, or fiberboardtype material, which have been partially precut, as by perforating, etc., in incremental ring-like widths, in the same general manner as the window shade material, so as to provide segments which can be manually torn or broken off, thereby shortening the length of the roller (for example, see U.S. Pat. No. 4,102,384). While appearing to have possible economic advantages as well as functional advantages when compared to the telescoping metal rollers noted above and their two-step shade attachment requirements, such break-off rollers nonetheless involve significant disadvantages as well; for example, providing the numerous perforated break-off segments is labor intensive and expensive as a manufacturing process, and in actual practice the segments may well not be easy to break off, and may leave jagged or irregular edges. Further, and perhaps more importantly, the extent of the required pre-cutting substantially weakens the roller structure since it removes much of its beam strength. Thus, if such a paper or paperboard tube has been pre-cut sufficiently to provide reasonably easy manual break-off or other segmental shortening at home by the consumer, without tools, the resulting shade roller has probably been so weakened as to be in danger of failing or of being unsatisfactory during use, as when the window shade is pulled downward (unrolled) its full length by downward force loading applied to the center of the end-suspended roller by grasping the bottom edge of the shade panel and pulling downwardly. Such failure or malfunction is made even more likely by the stresses and strains imposed during the manual sizing operations done by the consumer, who grasps the pre-cut and weakened shade roller in both hands and subjects a significant portion of it to bending in order to tear off or break off the desired segment of the roller.

THE PRESENT INVENTION

The present invention provides new and desirable solutions to the problems described above, as well as others involved in prior shade rollers used with hand-strip window shade panels. In so doing, the invention provides new tube constructions, particularly useful for window shade support rollers (as well as other more general applications), together with a new and convenient method and apparatus for reducing the length of the tubular window shade roller by removal of end portions thereof.

More particularly, in achieving its aforementioned improved results, the present invention provides new and desirable tube constructions having the advantages of high beam strength in relation to wall thickness and weight, together with simplicity and desirable economy of manufacture, as well as relatively low unit weight and, particularly in the most preferred embodiment, extremely thin wall sections. Further, together with and apart from the foregoing objectives and advantages of the invention, the invention provides a novel and desirable tear-strip-type structure for separating one or more desired segments from the remainder of the roller. At the same time, the tear-strip-type separation means nonetheless provide a roller member of substantially uniform diameter, without undesirable surface discontinuities, which does not cause structural weaknesses in the overall roller support member. The tear-strip means provide the consumer with a desirable measure of certainty and familiarity for the overall structure and roller shortening procedures, while also providing convenient and readily operable means for shortening the roller to a desired length, following the removal of the desired portion of shade panel material along one or both edges, in order to accommodate a particular size of window or the like.

In accordance with the overall or broader aspects of the invention, two embodiments of the roller structure are disclosed, each of which has certain advantages of its own although one is perhaps the most preferred; similarly, two embodiments of the tear-strip means are disclosed, and each of these also has its own advantages, although having many similarities. Once again, a potentially preferred embodiment of the tear-strip means is disclosed and discussed.

A more complete understanding of the invention and of its underlying concepts will become more apparent by reference to the ensuing detailed description of preferred embodiments and by reference to the attached drawings illustrating the same, together with reference to the appended claims.

DESCRIPTION OF THE PREFERRED EMBODIMENTS

Generally stated, in accordance with the present invention a lightweight but very strong window shade support roller is provided which is comprised of an outer paper-like tube having one or more wraps of sheet material which are coated with adhesive prior to wrapping and which are wrapped in tight mutual adhesion at practically all points of surface-to-surface contiguity. Together with this form of strong and lightweight roller construction, the shade roller support includes a plurality of mutually spaced, parallel "tear strips", i.e., tear strips or tear tape, adhesively attached to the sheet material forming the aforementioned wraps and wound with such material when it is formed into a tubular structure. Thus, the turns of tear-strip material in effect take the form of a generally planar, spiral-type winding having its outermost end extremely substantially coterminous with, and underlying, the outermost edge of the sheet material to which it is attached, the latter having been wound into tubular form. This outer end of the tear-strip material, when grapsed and pulled radially of and annularly around the completed window shade support roller, acts to progressively sever the coiled (wound) sheet material, ultimately severing all of the layers and thus the entire wall section of the tube into which the sheet material is formed thereby effecting shortening of the shade roller itself in an easy and simple manner.

Figure 1:
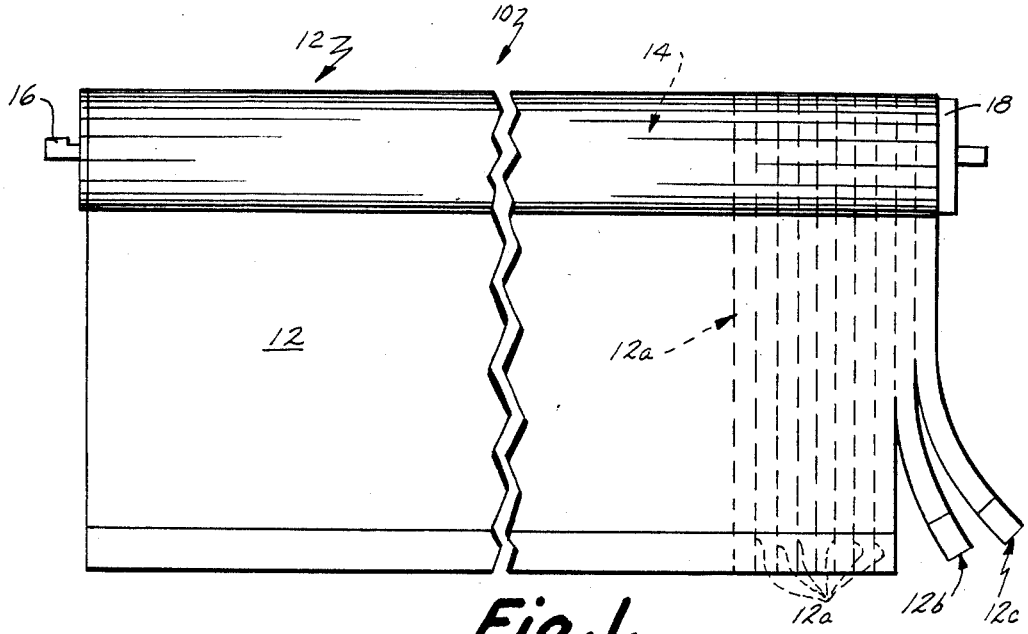
FIG. 1 is a fragmentary elevational view of a typical window shade and support roller in accordance with the embodiments of the invention and employing pre-scored "hand-strip" shade material.
Figure 2:
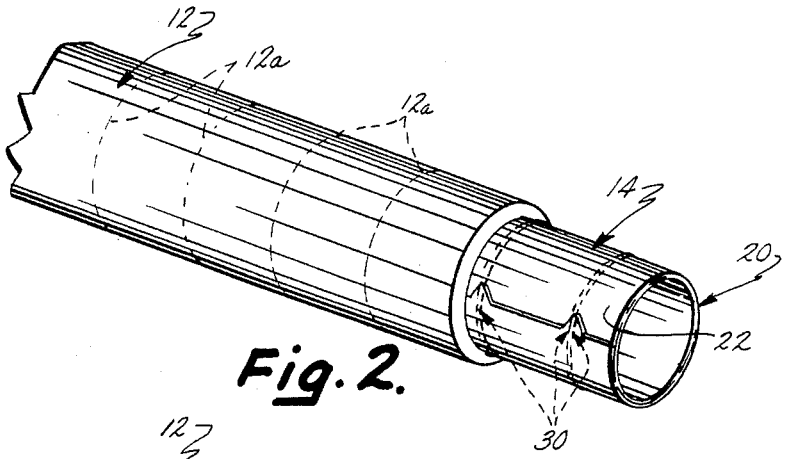
FIG. 2 is an enlarged, fragmentary perspective view of one end portion of the shade and roller in accordance herewith.

In FIG. 1, a window shade and roller assembly 10 is depicted, comprising generally a shade panel 12 of sheet material wound upon a support roller structure 14, which should be considered as including conventional-type suspension means 16 and 18 at each end. As will be understood by those skilled in the art, the suspending means 16 comprises the projecting blade end of a spring motor assembly (e.g., as shown in U.S. Pat. No. 4,009,745) mounted within the roller tube, while the suspension member 18 comprises a pin end plug or the like, which may be of a known type, for example, as shown and discussed in prior U.S. Pat. No. 3,581,800.

As further illustrated in FIG. 1, the shade panel 12 preferably utilized in the present invention is of the pre-scored "hand-strippable" type (as shown or referred to, for example, in prior U.S. Pat. Nos. 4,006,770 and 4,102,384), which includes a plurality of elongated stripping lines **12*a* (shown by dashed lines) comprising for example scorngs or slits cut partially through the shade material, which are generally considered invisible to the naked eye but which nonetheless permit discrete widths of the shade panel, e.g., widths 12*b* and 12*c***, to be manually separated from the remainder of the shade and peeled or stripped from its edge, thereby narrowing the overall shade panel by the width of the segment peeled off.

A first form of the novel shade roller support member in accordance herewith is illustrated in FIGS. 2–7, inclusive. As seen there, the support roller 14, carrying the coiled shade panel 12 about its exterior, includes an outer tubular member 20 formed of at least one, and preferably a plurality, of wraps of sheet material 22. In accordance with a preferred embodiment of this invention, the outer wraps of the sheet material 22 are smoothly and tightly wound one upon the next, and are adhesively secured to one another at all points of mutual surface contact. Preferably, the sheet material 22 is of paper stock, and may be conventional Kraft paper, for example, 90 pound Kraft paper, although 120 pound is preferred. A more important consideration than the weight of the Kraft paper is its characteristics, i.e., the sheet 22 is preferably of non-directional tearing characterstics, and this may be provided, for example, by using the type of Kraft paper known as "Stress Kraft", which is also sometimes known as "bag stock".

In order to produce the strongest and most desirable tube, the outer wraps 22 are smoothly and continuously adhered to one another at substantially all points of mutual surface contact. A preferred adhesive media for accomplishing this purpose, particularly where the sheet material 22 is the preferred Kraft stock, is silicate of soda, which is thin and absorbs well into the paper media, and which additionally is not tacky when wet, yet dries brittle. With such an adhesive, the paper stock may be coated during the winding process in which the outer tubular member 20 is formed (for example, by roller applicator contacting the web of supply paper stock along its winding path, adjacent the actual winding station).

Figure 6:
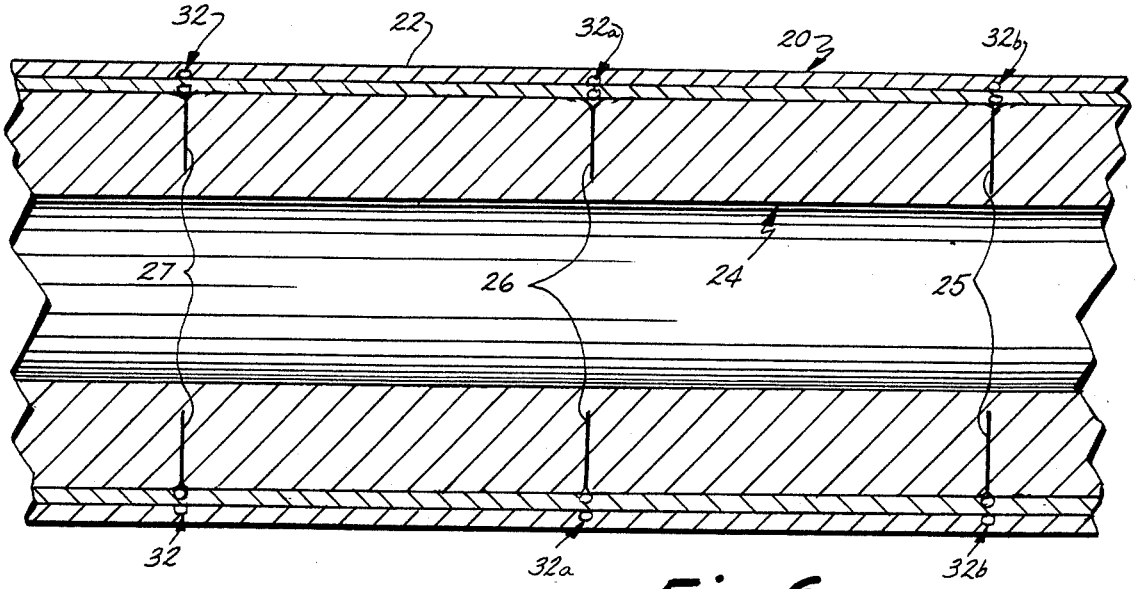
FIG. 6 is an enlarged, fragmentary central sectional elevation showing details of a first embodiment of the present window shade roller structure.

It will be noted in FIG. 6 that the embodiment of the shade roller support depicted there includes, in addition to the outer tubular member 20, an inner tubular support member 24. In such a construction, the inner tubular member 24 is annularly slit or recessed around its outer diameter at regular intervals, to form a plurality of mutually-spaced, narrowed-diameter or necked-down wall sections 25, 26, 27, etc. This provides regularly spaced segments which may readily be broken off to separate one such segment from another, in a manner to be described subsequently; however, such a segmental structure is, in and of itself, lacking in desired beam strength and might well not be able to withstand the typical bending stresses placed upon a window shade roller during its normal operation, with a shade panel rolled around its exterior a number of times, and the entire assembly suspended only from the end portions and yet being operated (i.e., drawn down) by applying downward force acting at the center area of the shade roller, i.e., by grasping the bottom edge extremity of the window shade panel and pulling it downwardly.

In accordance with this invention, the inner tube portion 24 is substantially and integrally reinforced by the outer tubular portion 20, comprised of the adhesively secured wraps of sheet material 22. At the same time, in accordance with the invention, the separation of segments in order to effect shortening of the overall length of the window shade roller is substantially enhanced and facilitated. This result is achieved by the tear-strip means 30 of the invention, a first embodiment of which is illustrated in FIGS. 3 and 6, for example.

The first embodiment of the tear-strip means 30 comprises a series of adjacent tear strings 32, 32*a*, 32*b*, etc. (FIG. 6), each of which comprises a length of string material adhesively secured to the underside of the sheet stock 22 prior to the winding thereof by which the tube 20 is formed. In this arrangement, when the sheet stock is wound to form the outer tube 20, the various tear strings 32, 32*a*, 32*b*, etc., are each coiled annularly about previous turns of the same string, each string thus being coiled into a spiral pattern between layers of the sheet stock 22, with each such spiral of string lying essentially in its own separate plane. As illustrated in FIG. 3, the outermost wrap of sheet stock 22 terminates along an edge 22', and this edge defines a series of tabs 23 with which each of the tear strings 32 is aligned, the end extremity of the tear strings preferably being adhesively secured to the underside of the individual tabs 23.

Figure 3:
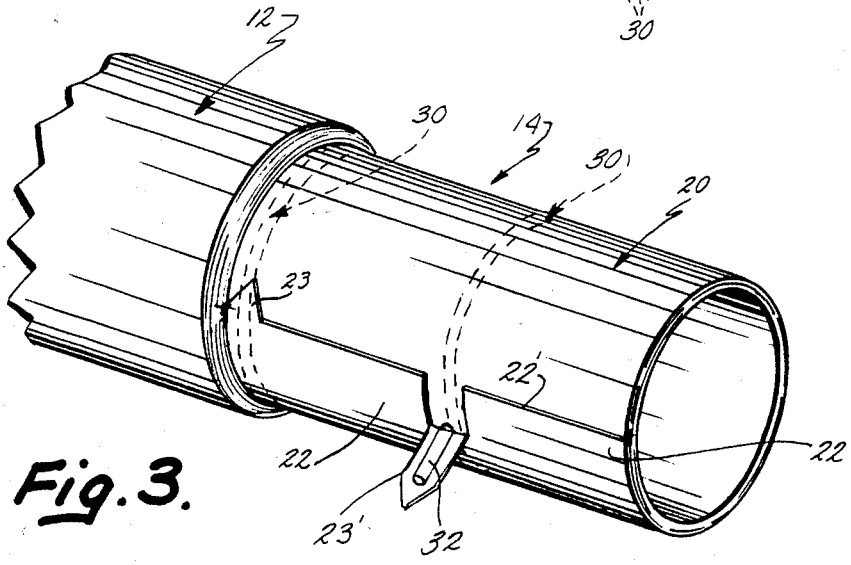
FIG. 3 is a further enlarged, fragmentary perspective view of the structure of FIG. 2, showing further details thereof.
Figure 4:
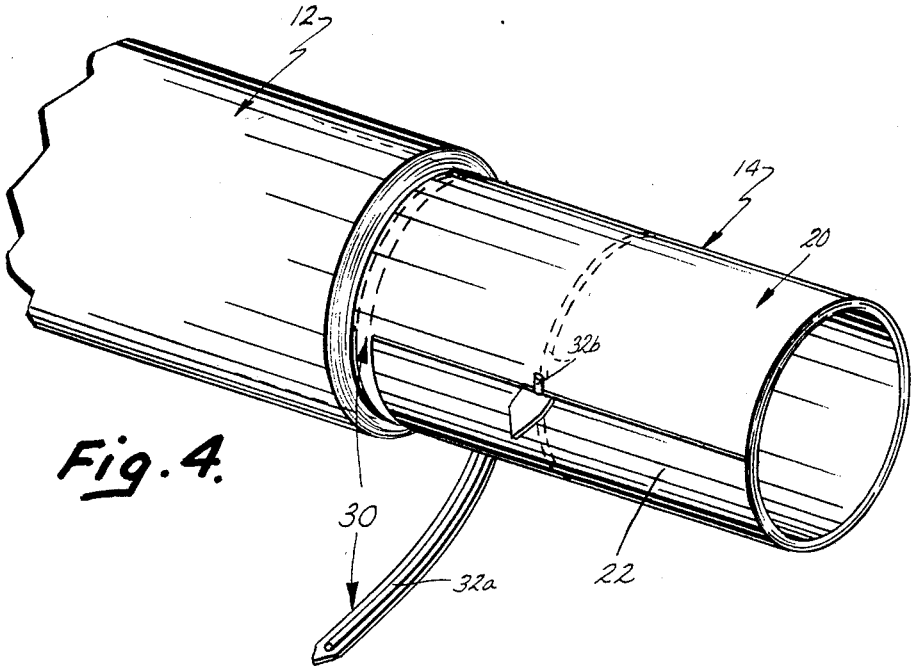
FIG. 4 is a perspective view similar to FIG. 3 but showing operation of the tear-strip roller-shortening means.
Figure 5:
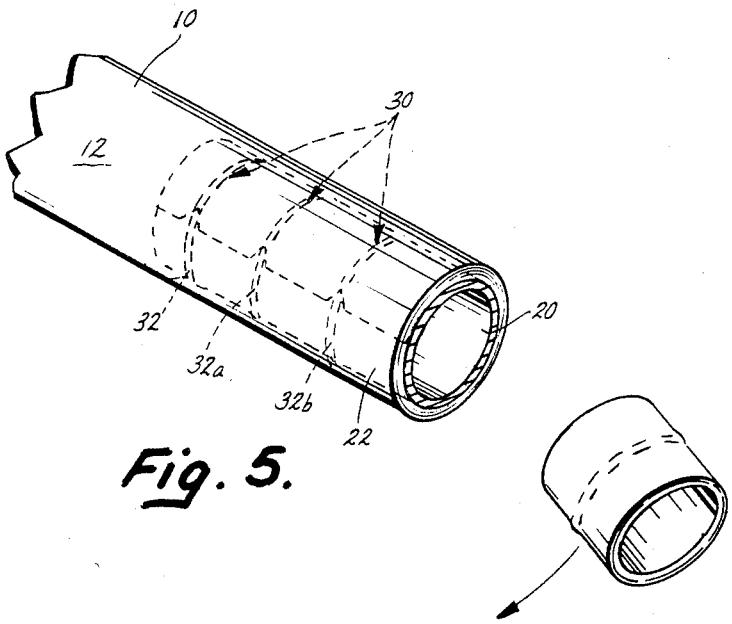
FIG. 5 is a perspective view on a reduced scale illustrating the shade roller of FIG. 4 as it appears immediately following separation of a segmental end portion of the shade roller.

It is important for convenience of use that the various tabs 23 not be tightly secured adhesively in place against the adjacent surface of the outer tubular member 20, since it is desired to have the various tabs 23 be readily accessible to manual manipulation from the position shown at the left in FIG. 3 (which is the normal position occupied by the tab) to the position shown at the right, wherein the tab is designated by the numeral 23', the same having been in effect bent or folded away from its previous position (for example, by light fingernail pressure applied from the underside of the tab). Thus, any selected tab should be readily movable to a position in which it lends itself to gripping, as between the thumb and forefinger of the user. Once so gripped, the tear string may be pulled radially of and around the circumference of the roller to effect severance of the latter, each incremental section of the tear string in effect being continuously torn upwardly and outwardly through the single layer of sheet material 22 overlying it.

As stated above, it is desirable to prevent strong adhesion of the tabs 23 to the outer surface of the outer tubular member 20, and this result may be achieved even though the sheet material is in effect completely coated with the desired adhesive prior to winding of the sheet material into the tubular form if, prior to encountering the adhesive, the tabs are treated (e.g., coated or wetted) with a medim to which the adhesive does not attach itself. One common example of such a medium is ordinary vinegar, particularly useful where the preferred adhesive, silicate of soda, is used. This "anti-adhesive" substance may be appled to the tabs automatically at the time the tabs are formed, i.e., during cut-off of the sheet stock at the desired length, when the aforementioned exposed edge 22' is formed. That is, such cut-off may be achieved by use of a cutting die, for example, which may be equipped with an applicator medium saturated with, or otherwise carrying, the anti-adhesive medium, so that the latter is applied directly to the endmost extremity of the sheet stock, i.e., across the tabs, as the sheet is cut by the die.

Figure 7:
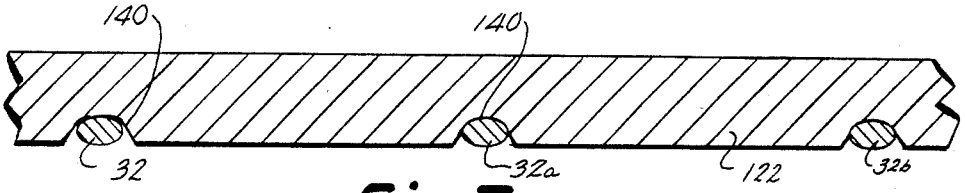
FIG. 7 is an enlarged, fragmentary side elevational view, showing one form of the tear-strip means.

As illustrated in FIG. 7, wherein a separate segment 122 of the sheet material is shown on an enlarged scale, the individual tear strings 32, 32*a*, 32*b*, etc. are preferably located within a corresponding recess or indentation 140, which may be formed by drawing the sheet or paper stock beneath appropriate compression rollers, typically at a point immediately preceding application of the tear strings, although it may be desired to apply the adhesive between these two operations since the tear strings should be adhered in place. The paper stock is, typically, on the order of about 10 mils. thick, whereas the diameter of the tear string is less than half that thickness; consequently, the tear strings may be positioned in place within an appropriately-sized compression groove or indentation 140, in a manner such that the tear strings do not protrude appreciably beyond the adjacent surface of the paper sheet. Under these circumstances, when the paper is rolled, i.e., wound upon itself, to form the outer tube 20, the tear strings will not form readily-perceptible annular circumferential protrusions or ridges which, generally speaking, are undesirable in window shade rollers for many reasons. In this connection, it may be desirable to include a wide pressure roller downstream from the point at which the tear strings are applied to the sheet stock 122, with respect to the direction of movement of the latter during the process, with such pressure roller extending laterally across the entire widht of the sheet stock 122, or at least across that portion of the latter which carries the parallel, longitudinally-extending tear strings. In such an approach, a precisely-spaced backup or opposing roller, or other opposed surface, may be utilized to in effect size the thickness of the composite sheet and tear strings, and in this approach the tear strings may be compressed somewhat diametrically, even to the extent of making them egg-shaped or oval in cross section, and/or pressing the tear strings further into the surface of the sheet stock.

In connection with the tear strings just described, while many specific commercially-available types of thread or string could perhaps be used for the intended purpose, a preferred embodiment is a composite commercially available nylon and rayon bonded thread, which is twisted longitudinally and thus embodies a desirable textured surface, as well as having small diameter and high strength, all such attributes contributing desirably to the overall composite structure and to the tear string action.

Figure 8:
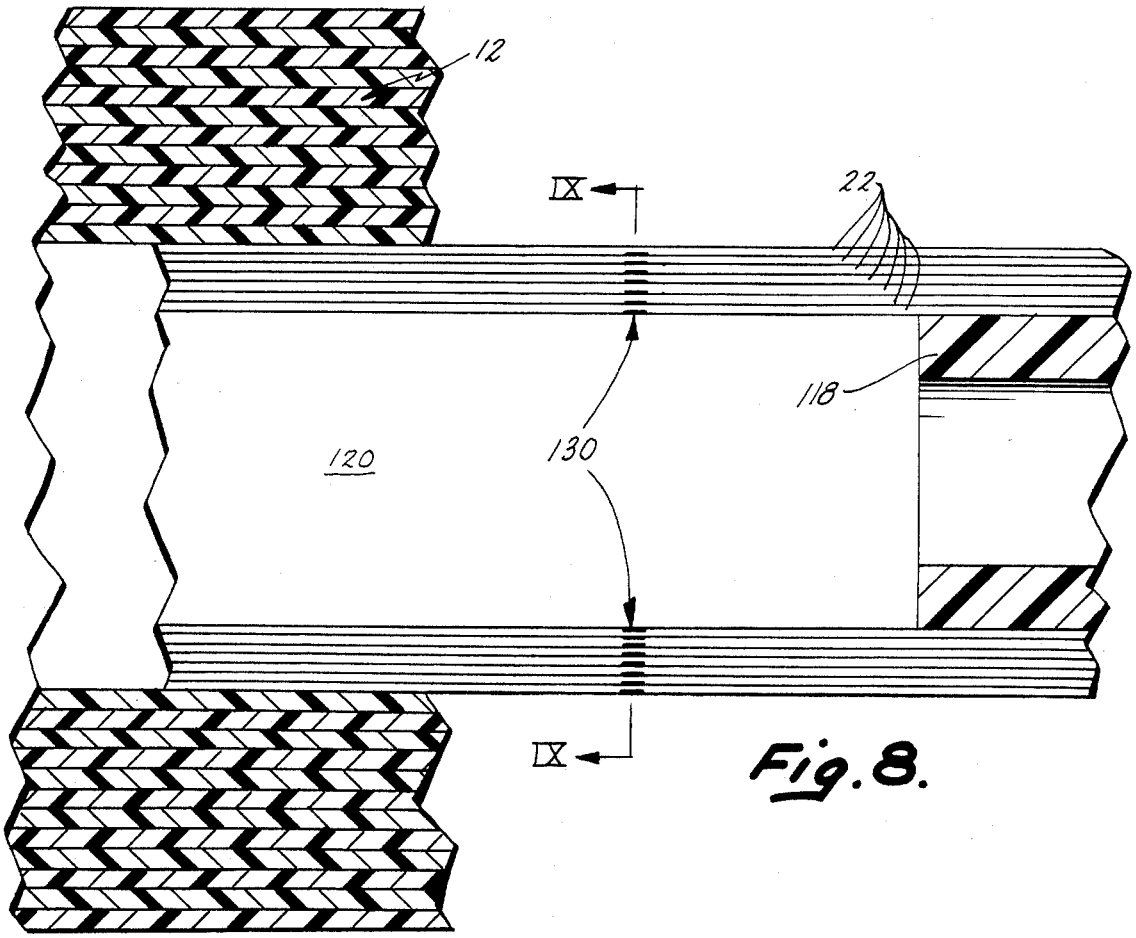
FIG. 8 is an enlarged, sectional elevational view similar to FIG. 6 but showing details of a second and preferred embodiment of the roller structure in accordance with the invention.
Figure 9:
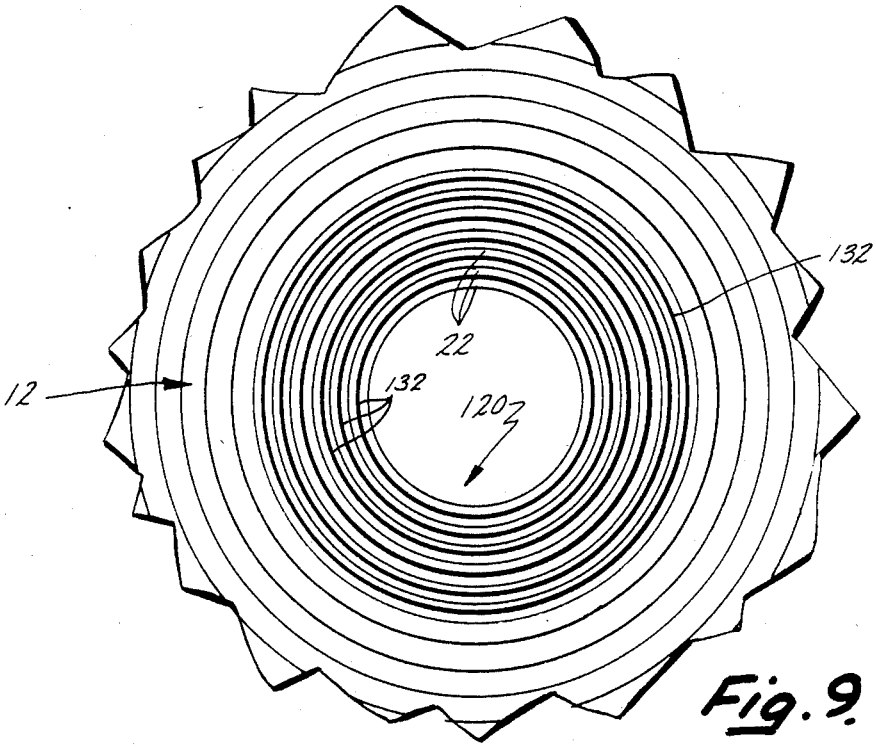
FIG. 9 is a fragmentary, cross-sectional view taken through the plane IX—IX of FIG. 8.
Figure 10:
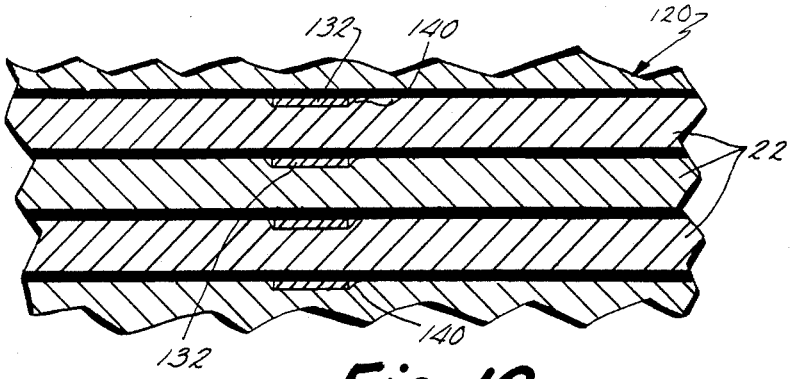
FIG. 10 is a further enlarged, fragmentary, sectional view similar to FIG. 7 but showing details of a second and preferred embodiment of the tear-strip means.

Notwithstanding the fact that tear strings as described hereinabove may be utilized to provide generally satisfactory results, a more preferred "tear strip" is of the tear tape variety, as illustrated in FIGS. 8, 9 and 10. In the embodiment there shown, a tubular member 120 carries the window shade sheet material 12 wound about its periphery, but in this embodiment the outer tubular member 120 comprises the entire window shade support roller there being no inner tubular member 24, and the end plug (here designated 118) fits directly into the inside diameter of the tubular member 120.

The embodiment of the window shade roller support member 120 shown in FIGS. 8–10, inclusive, is in a general sense constructed much the same as the outer tubular member 20 discussed above, but it includes a number of additional windings or layers of the sheet stock 22, all of which are securely adhered to one another in direct layer-to-layer contact. By so doing, and by using on the order of six mutually secured wraps of the sheet stock, it has been found that a surprisingly strong and lightweight window shade roller may be achieved, without utilizing additional support structure. For example, by use of this construction a tubular support member with a wall thickness of fifty thousandths of an inch (0.050″) has been found to have ample strength (beam strength) to perform satisfactorily for the intended purpose, and in fact to have a remarkably high degree of beam strength.

As noted above, the embodiment of the invention shown in FIGS. 8, 9 and 10 also depicts a tear tape roller-severing means 130, as opposed to the tear string means 30 discussed above, although in this connection it is to be understood that either type of such severance means may of course be utilized with either type of roller structure (i.e., that of FIG. 6 or FIG. 8). The tear tape embodiment 130 is similar in a number of ways to the tear string embodiment 30. For example, each of the individual lengths of tear tape 132, 132*a*, etc., are preferably disposed within a complementary groove or indentation 140 (FIG. 10), such that the outer surface of the tear tape is essentially flush with the outer surface of the sheet stock 22; thus, when the layers or windings of sheet stock are coiled one over the other and tightly adhesively bound together, the various tear tapes do not form an appreciable outward bulge (annular ridge) at that point along the length of the roller. Insofar as the individual tear tapes are concerned, commerically-available types of tear tape stock may be used, for example, polypropylene strips approximately 2 mils. thick and on the order of 5/64 inch wide. As in the previously discussed embodiment of the tubular roller support structure, the sheet stock 22 may be of the same nature, e.g., "Stress Kraft" paper, and the adhesive media may be the same, e.g., silicate of soda. Other attributes of the outer tubular member 20, as discussed above, may also be utilized in the embodiment 120, e.g., the tabs 23 and their treatment during manufacture to avoid tight adhesion thereof against the outer surface of the roller. Of course, operation of the tear tape to effect severance of the shade roller is much the same as that of the tear string means.

Accordingly, it will be seen that new and significantly improved embodiments of basic tubular stock have been described and disclosed hereinabove, particularly as used for the indicated application, i.e., window shade roller support members. Additionally, new and significantly improved window shade roller severance means are provided by way of two alternative embodiments. Of the two, while both have evident similarities, as well as certain differences, it is presently believed that the embodiments shown in FIG. 8 are to be preferred, both with respect to the roller support member construction and with respect to the roller severance means.

Having now described one or more particularly preferred embodiments of my invention, those skilled in the art will understand that various changes and alterations can be made without departing from the underlying concepts and broader aspects of the invention as set forth in the appended claims, which are to be interpreted in accordance with such underlying concepts and broader aspects and by application of a full range of equivalents.

The embodiments of the invention in which an exclusive property or privilege is claimed are defined as follows:

1. A tubular roller for window shades, comprising: an elongated cylindrically-shaped roller member; means at each end of said roller member for suspending it between a pair of spaced mounts; said roller member having an integrated and unitary internal structure which provides sufficient beam strength to support both said roller member and an elongated sheet of window shade material coiled around the roller member without substantially bowing or drooping; said integrated and unitary internal structure consisting of on the order of about six wraps of sheet material wound upon themselves and adhesively secured together to substantially prevent relative slippage between the adjacent surfaces of successive wraps, said sheet material forming said adhered wraps having the structural characteristics of 90-to-120 pound test Stress Kraft including non-directional tearability and a sheet thickness on the order of about 0.010 inch, said adhered wraps constituting integrated laminar supports which together provide substantially all of the beam strength of said roller required to substantially prevent bowing or drooping medially of the roller when the latter has a window shade wound thereupon and is suspended from its opposite ends.

2. A window shade roller according to claim 1, wherein said adhesively secured plurality of coiled wraps comprises the only structural support extending between the ends of said roller member.

3. A window shade roller according to claim 1, wherein said coiled wraps comprises a paper-like material, and the adhesive securing the wraps to one another has the characteristics of silicate of soda and covers substantially the entire surface area between wraps.

4. A window shade roller according to claim 1, wherein said roller member includes a plurality of mutually-spaced elongated tensile members comprising tear line means located generally orthogonal to the axis of said roller member: each of said tensile members when pulled transversely and annularly with respect to said roller member acting to at least partially sever said roller member transversely of its longitudinal axis, to thereby facilitate removal of a discrete length of roller member and hence effect shortening of such member by said discrete length.

5. A window shade roller according to claim 4, wherein said roller support member has a plurality of said mutually-spaced tensile members which are each coiled in a series of generally coplanar spiral-type turns so as to sever said roller along the respective planes of said tensile members when each such coiled tensile member is pulled.

6. A window shade roller according to claim 5, wherein said tensile members comprise tear tapes.

7. A window shade roller according to claim 5, wherein said tensile members comprise tear strings.

8. A window shade roller according to claim 4, wherein said adhesively-secured plurality of coiled wraps comprises the primary structural support of the roller member and provides substantially all of the required beam strength to prevent bowing and drooping of the shade and roller, and said roller member includes an inner tubular member disposed generally concentrically within said adhesively-secured coiled outer wraps, said inner tubular member including a plurality of transverse generally annular necked-down wall areas disposed generally perpendicular to the longitudinal axis of the roller member, said necked-down wall areas comprising a series of hidden, mutually-spaced separability planes covered by said coiled wraps, whereby the window shade roller may be shortened in length by pulling a tensile member transversely of and annularly around said roller member to sever said coiled wraps and then removing sections of said tubular member between one or more such necked-down wall areas, each of said tensile members being substantially aligned with a different one of said separability planes.

9. A window shade roller according to claim 8, wherein said necked-down wall areas of said inner tubular member comprise narrow, generally annular slit-like wall thickness reductions traversing a major portion of the wall thickness of said inner tubular member.

10. A window shade roller according to claim 4, wherein said sheet material comprising said coiled wraps has a thickness on the order of about three to five times that of said tensile members.

11. A window shade roller according to claim 1, wherein said sheet material comprising said adhered wraps comprises "stress"-type Kraft paper.

* * * * *

UNITED STATES PATENT AND TRADEMARK OFFICE

CERTIFICATE OF CORRECTION

PATENT NO. : 4,566,517

DATED : January 28, 1986

INVENTOR(S) : Terry L. Simon

It is certified that error appears in the above-identified patent and that said Letters Patent is hereby corrected as shown below:

Column 4, line 9:
"strips" should be --strings--.

Column 4, line 14:
"extremely" should be --extremity--.

Column 4, line 44:
"scorngs" should be --scorings--.

Column 6, line 42:
"or" should be --of--.

Column 6, line 65:
"widht" should be --width--.

Signed and Sealed this

*Twenty-second* Day of *July 1986*

[SEAL]

*Attest:*

DONALD J. QUIGG

*Attesting Officer* *Commissioner of Patents and Trademarks*